US007471053B2

(12) United States Patent
Miyake

(10) Patent No.: US 7,471,053 B2
(45) Date of Patent: Dec. 30, 2008

(54) MULTI-BEAM KLYSTRON APPARATUS

(75) Inventor: Setsuo Miyake, Nasushiobara (JP)

(73) Assignees: Kabushiki Kaisha Toshiba, Tokyo (JP); Toshiba Electron Tubes & Devices Co., Ltd., Tochigi-Ken (JP)

( * ) Notice: Subject to any disclaimer, the term of this patent is extended or adjusted under 35 U.S.C. 154(b) by 12 days.

(21) Appl. No.: 11/819,638

(22) Filed: Jun. 28, 2007

(65) Prior Publication Data

US 2008/0157677 A1 Jul. 3, 2008

Related U.S. Application Data

(63) Continuation of application No. PCT/JP2006/322031, filed on Oct. 27, 2006.

(30) Foreign Application Priority Data

Oct. 31, 2005 (JP) ..... 2005-317122

(51) Int. Cl.
*H05H 7/00* (2006.01)

(52) U.S. Cl. ..... 315/501; 315/503; 315/5.42; 313/153; 313/154; 313/428; 313/443

(58) Field of Classification Search ..... 315/500, 315/501, 506, 503, 5.42, 5.35; 313/153, 313/154, 421, 442, 443, 428; 250/396 R
See application file for complete search history.

(56) References Cited

U.S. PATENT DOCUMENTS 3,832,596 A * 8/1974 Nelson et al. ..... 315/3.5
5,548,183 A * 8/1996 Miyoshi et al. ..... 313/153
6,559,610 B2 * 5/2003 Tanaka ..... 315/506
7,385,354 B2 * 6/2008 Miyake ..... 315/5.39

FOREIGN PATENT DOCUMENTS

| | | |
|---|---|---|
| JP | 37-17336 | 10/1962 |
| JP | 40-5764 | 3/1965 |
| JP | 56-032647 | 4/1981 |
| JP | 11-016504 | 1/1999 |

OTHER PUBLICATIONS

International Search Report dated Jan. 23, 2007 for Appln. No. PCT/JP2006/322031 filed Oct. 27, 2006.

* cited by examiner

*Primary Examiner*—Haissa Philogene
(74) *Attorney, Agent, or Firm*—Pillsbury Winthrop Shaw Pittman LLP

(57) ABSTRACT

The present invention provides a multi-beam klystron apparatus. In the above-described multi-beam klystron apparatus, the magnetic field generating element of the electron-gun-unit-side magnetic field generating unit is disposed around the electron gun unit, and a plurality of magnetic gaps are provided in the inner peripheral surface of the magnetic pole, which covers the magnetic field generating element, in the direction of travel of the electron beams. Therefore, lines of magnetic force, which are parallel to the center axis of the radio-frequency interaction unit, can be generated. Thus, even the electron beam, which is generated from the location apart from the center axis of the electron gun unit, can be guided to the radio-frequency interaction unit in the same manner as in the location at the canter axis of the electron gun unit.

8 Claims, 8 Drawing Sheets

MULTI-BEAM KLYSTRON APPARATUS

CROSS-REFERENCE TO RELATED APPLICATIONS

This is a Continuation Application of PCT Application No. PCT/JP2006/322031, filed Oct. 27, 2006, which was published under PCT Article 21(2) in Japanese.

This application is based upon and claims the benefit of priority from prior Japanese Patent Application No. 2005-317122, filed Oct. 31, 2005, the entire contents of which are incorporated herein by reference.

BACKGROUND OF THE INVENTION

1. Field of the Invention

The present invention relates to a multi-beam klystron apparatus which amplifies radio-frequency power.

2. Description of the Related Art

There is known a klystron apparatus comprising a klystron main body which includes an electron gun unit which generates an electron beam, an input unit which inputs radio-frequency power, a radio-frequency interaction unit which amplifies the radio-frequency power by an interaction between the electron beam and a radio-frequency electric field, an output unit which outputs the radio-frequency power from the radio-frequency interaction unit, and a collector unit which collects the electron beam which has been used; and a converging magnetic field device which is mounted on the klystron main body and converges the electron beam.

The converging magnetic field device, in general, adopts such a structure that several to several tens of electromagnets, which generate lines of magnetic force in the axial direction of the klystron, are arranged main body. Annular coils of the electromagnets are disposed around the klystron main body. The electron beam is converged by electric fields which are generated by an electric current that is let to flow through the coils. The directions of the magnetic fields are the same on the axis of the electron beam from the cathode of the electron gun unit to the collector unit. The magnetic flux density is substantially uniform in the radio-frequency interaction unit. The magnetic flux density in the vicinity of the output unit is increased to some degree so as to prevent divergence of the electron beam. The magnetic flux density in the electron gun unit and collector unit is much lower than that in the output unit, and is set at a proper value.

An electron gun unit of a klystron apparatus, which uses a single electron beam, generally adopts magnetic field immersion type convergence. In this case, the diameter of an electron beam passage hole in a pole piece which is a magnetic pole on the input side of the radio-frequency interaction unit, the distance to the cathode of the electron gun unit, and the shape of the wehnelt of the electron gun unit are properly set. Thereby, the electron beam is converged in an inverse fashion, relative to the divergence of the line of magnetic force leaking from the hole in the pole piece.

It is generally known in the present technical field that the output conversion efficiency of the klystron apparatus becomes higher as the ratio of a beam current to a beam voltage, which is called "perveance", becomes smaller. It is also known that one means for achieving higher efficiency is a multi-beam klystron apparatus wherein the number of electron beams is increased from one in the prior art to several to several tens, the perveance of each electron beam is set at a low value, the beam voltage that is applied to the electron gun unit is set at a low value, and a totally high output conversion efficiency is obtained.

In a converging magnetic field device of this multi-beam klystron apparatus, a plurality of holes for passing a plurality of electron beams are formed at locations apart from the center axis of the pole piece. Thus, lines of magnetic force, which leak to the electron gun unit from the holes formed at locations apart from the center axis of the pole piece, diverge as the distance increases from the converging magnetic field device. Hence, it is necessary to arrange the cathodes of the electron gun unit in a three-dimensional fashion, for example, in a spherical fashion. In addition, in a magnetic field distribution that is used for ordinary magnetic field immersion type convergence, it is necessary to provide the pole piece with very large holes, relative to the beam diameter of the electron beam. As a result, an electron beam passing through a hole in the pole piece is affected by magnetic fields leaking from holes for other electron beams.

For example, as disclosed in Jpn. Pat. Appln. KOKAI Publication No. 11-16504 (pp. 3-5, FIGS. 1-3), there is a multi-beam klystron apparatus wherein cathodes of an electron gun unit are arranged in a plane, and not in a spherical fashion, thus giving consideration so as to generate a magnetic field that is suited to convergence of each electron beam. In this case, a shared pole piece, which is a magnetic body of, e.g. iron-nickel-cobalt type, is disposed near the cathode of the electron gun unit. In addition, a single magnetic field generating element, which projects to the electron gun unit side, is disposed on the converging magnetic field device. Further, at least one stage of an additional pole piece and a magnetic field generating element is provided.

In the above-described multi-beam klystron apparatus wherein consideration is given so as to generate a magnetic field that is suited to convergence of plural electron beams, a radial-directional component occurs in the magnetic field that is generated by the single magnetic field generating element projecting from the converging magnetic field device toward the electron gun unit. Consequently, the electron beam is deflected.

Besides, the structure becomes complex. In particular, since the shared pole piece is disposed in the electron gun unit, the electron gun unit becomes complex. The cathode of the electron gun unit is operated normally at about 100° C. As a result, the temperature of the wehnelt of the electron gun unit, as well as the cathode, rises to several-hundred ° C. The shared pole piece is disposed at a location that is immediately near the cathode and is surrounded by the wehnelt. With an increase in heat capacity of the vicinity of the cathode, there may occur an increase in heater power, an increase in discharge gas, and thermal deformation due to different kinds of metals. In consideration of the thermal deformation of structural components of the electron gun unit, it becomes difficult to design and manufacture the structural components in the normal-temperature state.

The on-axis magnetic field distribution on the beam axis is so adjusted as to become substantially equal to that of an ordinary single-beam tube. Hence, it is not possible to ignore the adverse effect on an electron beam passing through the hole in the pole piece due to the magnetic field leaking from the holes for other electron beams. A counter-measure to this is required.

The present invention has been made in consideration of the above-described problems, and the object of the invention is to provide a multi-beam klystron apparatus wherein lines of magnetic force, which are parallel to a center axis, are obtained near an electron beam axis apart from the center axis, without making an electron gun unit complex.

BRIEF SUMMARY OF THE INVENTION

According to the present invention, there is provided a multi-beam klystron apparatus comprising: an electron gun unit configured to generate a plurality of electron beams; an input unit configured to input radio-frequency power; a radio-frequency interaction unit configured to amplify the radio-frequency power, which is input from the input unit, by an interaction between the electron beams, which are generated by the electron gun unit, and a radio-frequency electric field; an output unit configured to output the radio-frequency power from the radio-frequency interaction unit; a collector unit configured to collect the electron beams which pass through the radio-frequency interaction unit; and a converging magnetic field device configured to include an electron-gun-unit-side magnetic field generating unit having a magnetic field generating element which is located around the electron gun unit and a magnetic pole which covers the magnetic field generating element and has a plurality of magnetic gaps in an inner peripheral surface thereof in a direction of travel of the electron beams, and configured to converge the electron beams generated by the electron gun unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will now be described with reference to the accompanying drawings.

FIG. 1 to FIG. 7 show a first embodiment of the invention.

Figure 1:
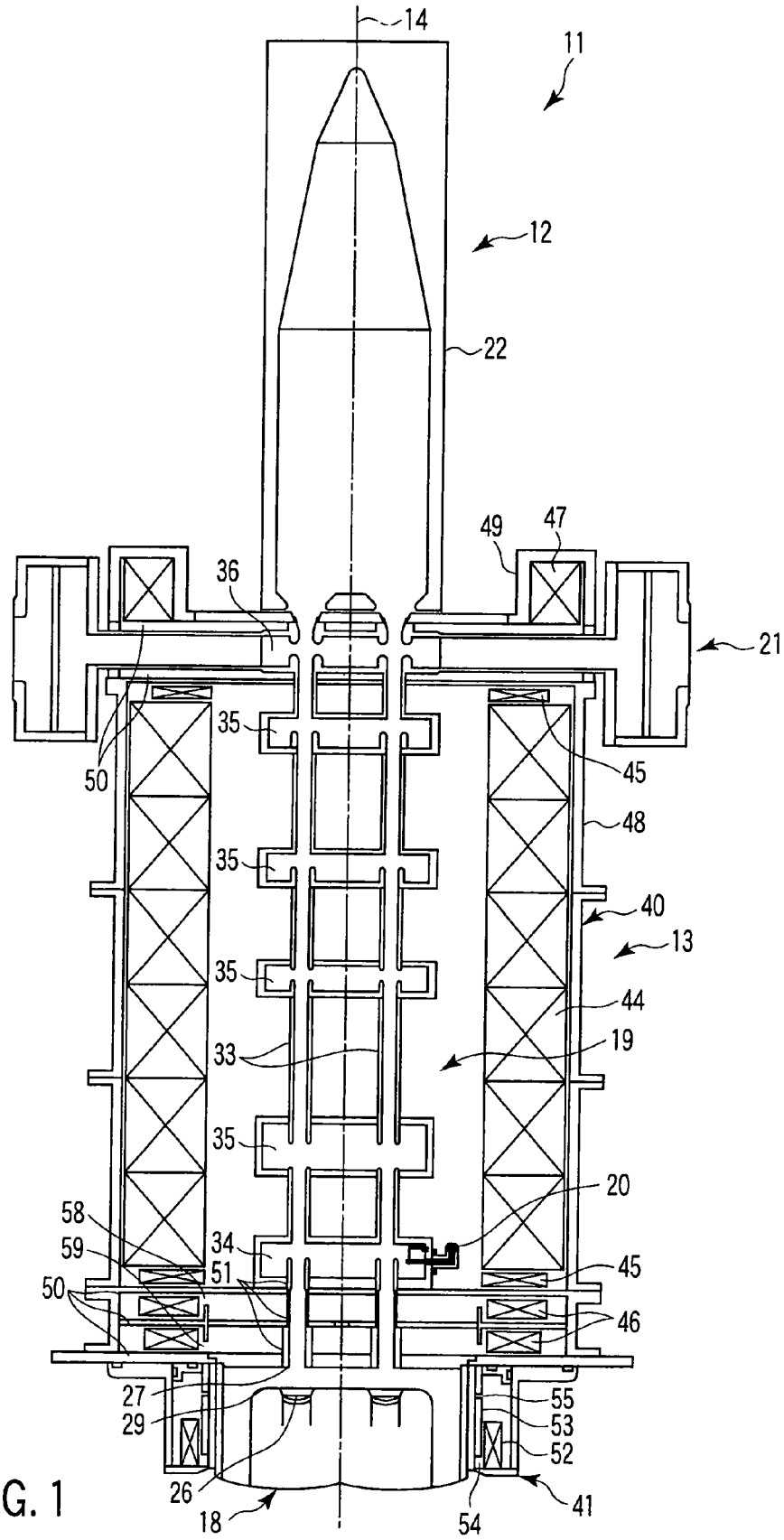
FIG. 1 is a cross-sectional view of a multi-beam klystron apparatus according to a first embodiment of the present invention.

As is shown in FIG. 1, a multi-beam klystron apparatus 11 includes a klystron main body 12 and a converging magnetic field device 13. In FIG. 1, reference numeral 14 denotes a center axis of the multi-beam klystron apparatus 11.

Figure 2:
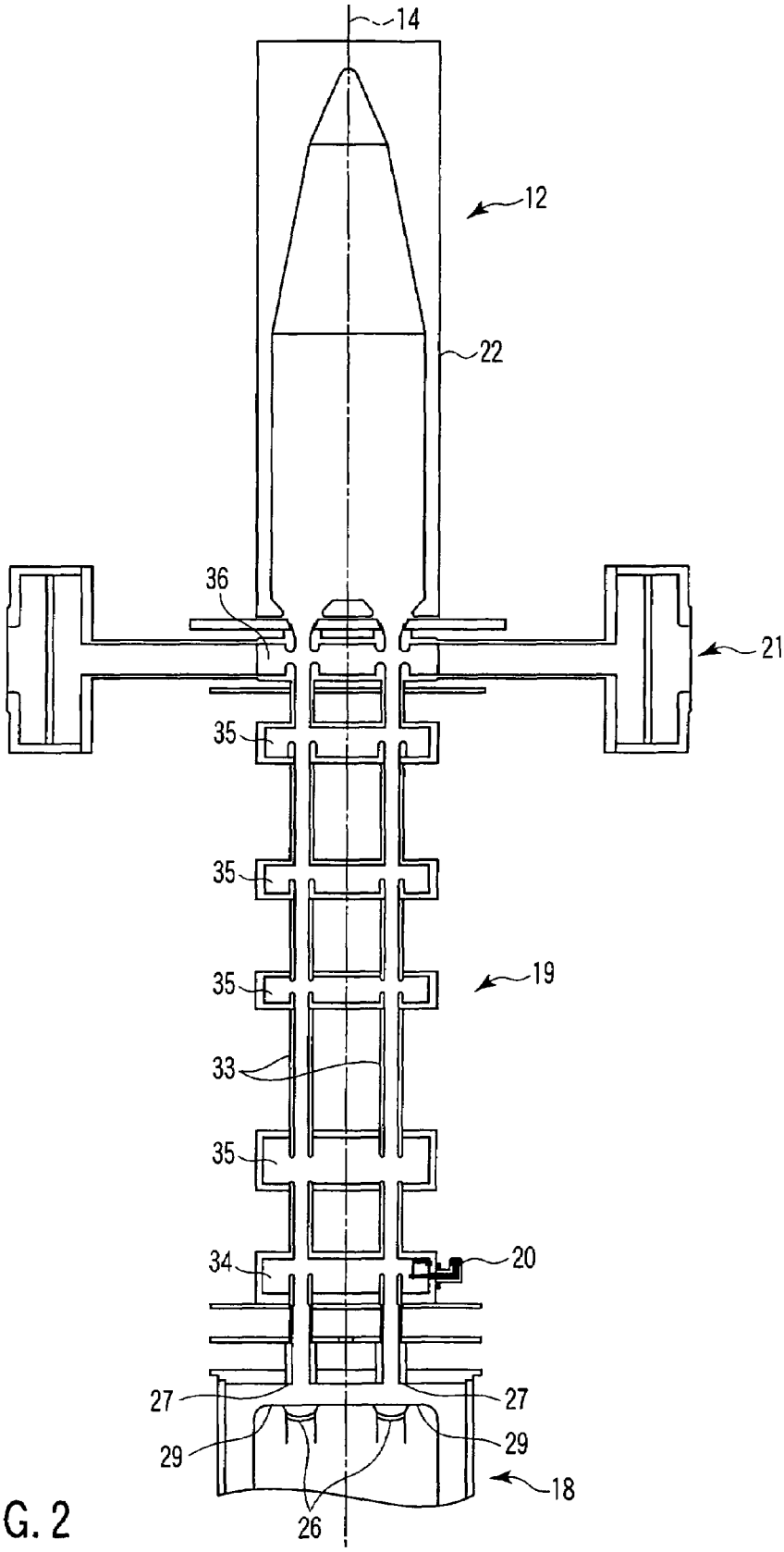
FIG. 2 is a cross-sectional view of a klystron main body of the multi-beam klystron apparatus.

As is shown in FIG. 2, the klystron main body 12 includes an electron gun unit 18, a radio-frequency interaction unit 19, an input unit 20, an output unit 21 and a collector unit 22.

The electron gun unit 18 generates a plurality of electron beams. The radio-frequency interaction unit 19 amplifies radio-frequency power by an interaction between the electron beams and a radio-frequency electric field. The input unit 20 inputs radio-frequency power to the radio-frequency interaction unit 19. The output unit 21 outputs the radio-frequency power from the radio-frequency interaction unit 19. The collector unit 22 collects the electron beam that has passed through the radio-frequency interaction unit 19 and has been used.

Figure 5:
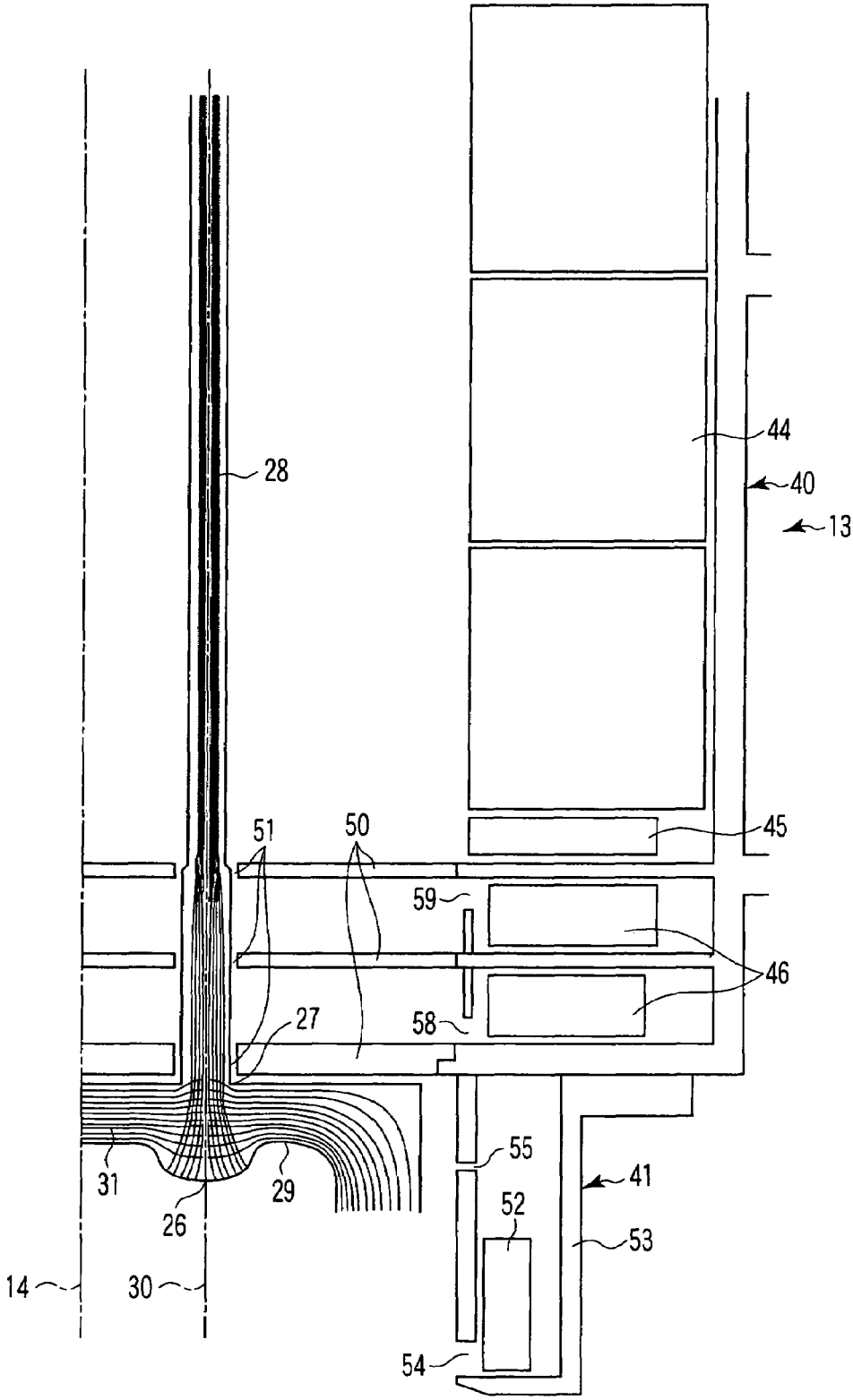
FIG. 5 is an explanatory view showing a beam trajectory analysis result of an electron beam of the multi-beam klystron apparatus.

The electron gun unit 18 includes a plurality of cathodes 26. The cathodes 26 are arranged on a circle defined about the center axis 14 and generate electron beams. As shown in FIG. 5, an anode 27 is disposed to be opposed to the associated cathode 26. A wehnelt 29, which converges the electron beam 28, is disposed around the cathode 26. In FIG. 5, numeral 30 denotes a center axis of the electron beam 28. Numeral 31 denotes equipotential lines within the electron gun unit 18.

As is shown in FIG. 2, the radio-frequency interaction unit 19 includes a plurality of drift tubes 33, an input cavity 34, a plurality of intermediate cavities 35 and an output cavity 36. The radio-frequency interaction unit 19 amplifies radio-frequency power by an interaction between the electron beams 28 and a radio-frequency electric field. The drift tubes 33 are arranged on a circle that is defined about the center axis 14. The respective electron beams 28 shown in FIG. 5 pass through the associated drift tubes 33. The input unit 20 is connected to the input cavity 34. The output unit 21 is connected to the output cavity 36.

Figure 3:
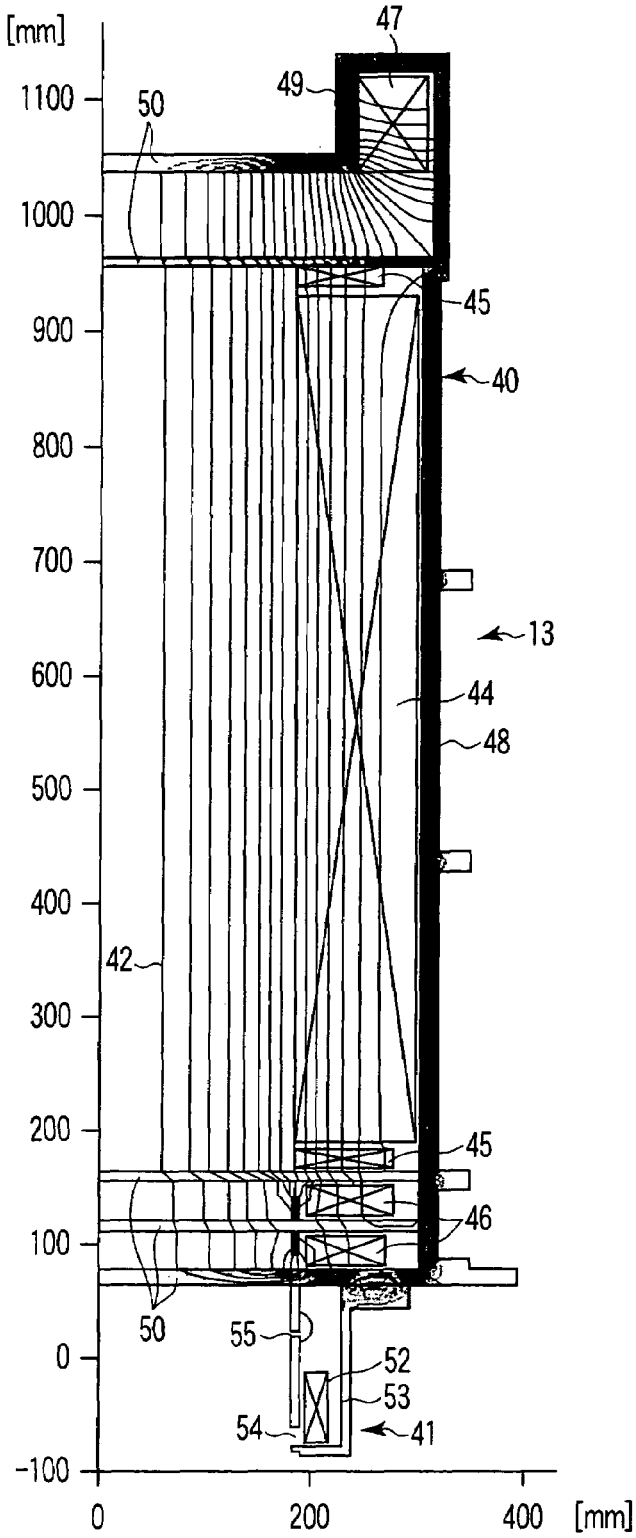
FIG. 3 is an explanatory view showing a line-of-magnetic-force analysis result of a converging magnetic field device of the multi-beam klystron apparatus.
Figure 4:
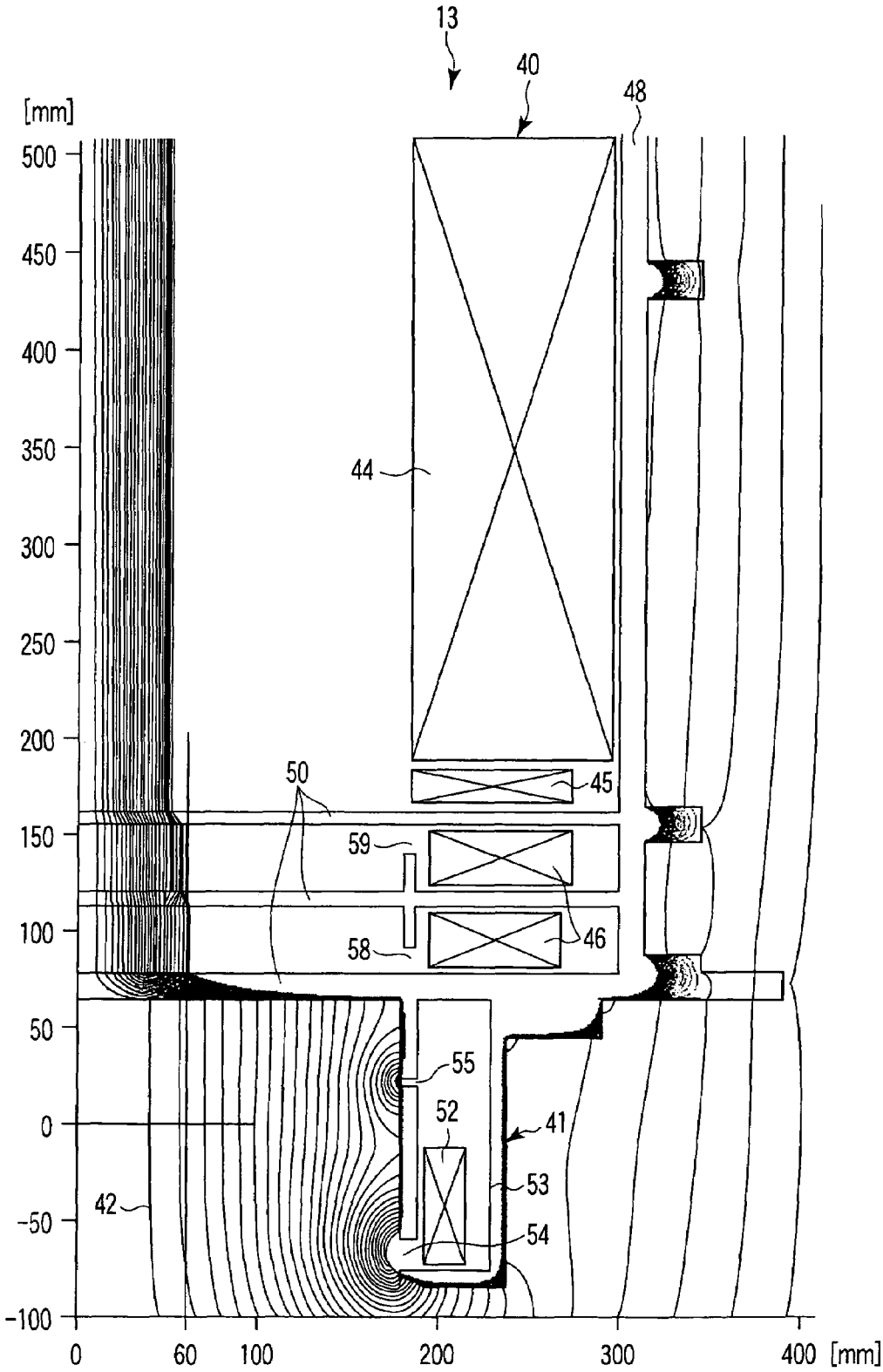
FIG. 4 is an explanatory view showing a line-of-magnetic-force analysis result of the converging magnetic field device of the multi-beam klystron apparatus, with the region of an electron gun unit of the multi-beam klystron apparatus being enlarged.

As is shown in FIG. 1, FIG. 3 and FIG. 4, the converging magnetic field device 13 includes a main magnetic field generating unit 40 and an electron-gun-unit-side magnetic field generating unit 41. The main magnetic field generating unit 40 is disposed around the radio-frequency interaction unit 19. The electron-gun-unit-side magnetic field generating unit 41 is disposed around the electron gun unit 18 at one end side of the main magnetic field generating unit 40. FIG. 3 is an explanatory view showing a line-of-magnetic-force analysis result of the converging magnetic field device 13. FIG. 4 is an explanatory view showing a line-of-magnetic-force analysis result of the converging magnetic field device 13, with the region of the electron gun unit 18 being enlarged. In FIG. 3 and FIG. 4, the abscissa indicates a radial distance, with the center axis of the multi-beam klystron apparatus being set at 0, and the ordinate indicates an axial distance, with design center coordinates of the cathode 26 being set at 0. In FIG. 3 and FIG. 4, numeral 42 denotes lines of magnetic force, which are generated by the main magnetic field generating unit 40 and electron-gun-unit-side magnetic field generating unit 41.

The main magnetic field generating unit 40 includes a main coil 44 which is elongated in the axial direction and functions as a main magnetic field generating element. Horizontal magnetic field correction coils 45 are disposed at both axial ends of the main coil 44. Two matching magnets 46, which function as magnetic field generating elements for correction, are disposed in the axial direction between one end of the main coil 44 and the electron-gun-unit-side magnetic field generating unit 41. The matching magnets 46 are magnets for correcting electron beam trajectories, and are matching coils. An output coil 47 is disposed on the other end side of the main coil 44 on the outside of the output cavity 36.

An outer peripheral magnetic pole 48 is disposed on the outer periphery of the coils 44, 45 and 47 and matching magnets 46, which are electron beam trajectory correction magnets. An inner peripheral magnetic pole 49, which is a return frame, is disposed on the inside of the coils 44, 45 and 47 and matching magnets 46. A plurality of pole pieces 50, which are discoid magnetic poles, are disposed at both ends in the axial direction of the outer peripheral magnetic pole 48, at both ends of the main coil 44 on the outsides of the horizontal magnetic field correction coils 45, and between the two matching magnets 46. The outer peripheral magnetic pole 48, inner peripheral magnetic pole 49 and pole pieces 50 are formed of magnetic bodies, and function to generate the magnetic fields of the coils 44, 45 and 47 and matching magnets 46 on the inside.

As is shown in FIG. 5, a plurality of holes 51 are formed in each of the pole piece 50. The plural holes 51 are arranged on a circle that is defined about the center axis 14. The electron beams 28 pass through these holes 51.

The electron-gun-unit-side magnetic field generating unit 41 includes a bucking magnet 52, which is a bucking coil and functions as a single magnetic field generating element. The bucking magnet 52 is disposed on the outside of the pole piece 50, which is disposed on the electron gun unit 18 side of the main magnetic field generating unit 40. The bucking magnet 52 is surrounded by an electron-gun-unit-side magnetic pole 53 which functions as a magnetic pole. The electron-gun-unit-side magnetic pole 53 is formed of a magnetic body which is coupled to the pole piece 50 that is disposed on the electron gun unit 18 side of the main magnetic field generating unit 40. The electron-gun-unit-side magnetic pole 53 has an outer peripheral magnetic pole, an inner peripheral magnetic pole, and magnetic poles at both axial ends. Two magnetic gaps 54 and 55 are formed in an inner peripheral surface of the electron-gun-unit-side magnetic pole 53. The two magnetic gaps 54 and 55 are provided at predetermined positions in the axial direction, that is, in the direction of travel of the electron beams.

In the multi-beam klystron apparatus 11, a plurality of electron beams 28 are generated at locations apart from the center axis 14 of the converging magnetic field device 13. At locations apart from the center axis 14, not only an axial magnetic field but also a horizontal magnetic field is generated at both ends of the main coil 44. Consequently, it is possible that the electron beams 28 are deflected. In order to suppress the horizontal magnetic field, the horizontal magnetic field correction coils 45 having high current density are provided on the upper and lower sides of the main coil 44 which has a large axial length. In addition, in order to suppress divergence of the electron beams 28 in the vicinity of the output cavity 36, the output coil 47 is provided. The pole pieces 50 for partition between the main coil 44 and output coil 47 are provided in order to avoid mutual effect between the main coil 44 and output coil 47. Thus, lines of magnetic force 42, which are parallel to the center axis 14, are obtained at the region of the radio-frequency interaction unit 19, where the electron beams 28 travel.

In the case where the number of bucking magnets 52 of the electron-gun-unit-side magnetic field generating section 41 is one, the length of each of the two magnetic gaps 54 and 55 is adjusted such that the length of the magnetic gap 54 on the upstream side of the electric beam 28 is increased and the length of the magnetic gap 55 on the downstream side of the electric beam 28 is decreased. Thereby, as shown in FIG. 4, liens 42 of magnetic force, which are parallel to the center axis 14, can be obtained near the electron beam axis apart from the center axis 14 by leak magnetic fields from the two magnetic gaps 54 and 55.

FIG. 4 depicts the lines 42 of magnetic force only in the region where the leak magnetic fields from the magnetic gaps 54 and 55 on the inner peripheral side of the bucking magnet 52. A scale value 60 mm on the abscissa indicates a design center value of the electron beam 28. A scale value 0 mm on the ordinate indicates design center coordinates of the cathode 26. In the case where the radius of the cathode 26 is set at 20 mm, it is understood that the lines 42 of magnetic force are substantially parallel to the center axis 14 in the range of 40 mm to 80 mm on the abscissa and in the range between 0 mm and the pole piece 50 on the ordinate.

In the case where parallel magnetic fields are applied to the electron gun unit 18, if only the electrostatic convergence by the wehnelt 29 of the electron gun unit 18 is adopted, such a ripple occurs that the electron beams 28 become wavy. In order to reduce the ripple, the two matching magnets 46, which are magnetic lenses, are disposed between the main coil 44 and horizontal magnetic field correction coil 45, on the one hand, and the bucking magnet 52, on the other hand. The pole pieces 50 are disposed on both ends of each matching magnet 46 in the axial direction. Magnetic gaps 58 and 59 are formed on the inner peripheral side of the respective matching magnets 46.

As is shown in FIG. 5 which illustrates a beam trajectory analysis result of the electron beam 28, if the matching magnets 46 are used, the electron beam 28 once bulges near the matching magnets 46, but the cross section of the electron beam 28 becomes uniform after the electron beam 28 passes beyond the region of the matching magnets 46.

Figure 6:
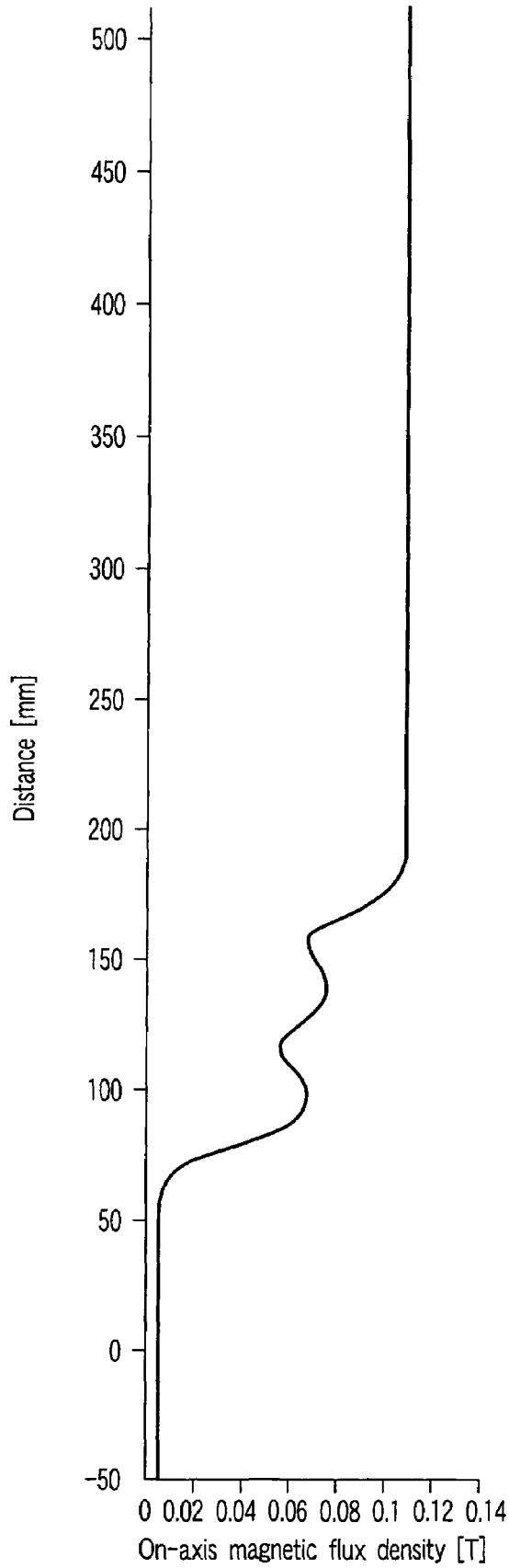
FIG. 6 is a graph showing a relationship between an on-axis magnetic flux density of the multi-beam klystron apparatus and an axial distance from the cathode.

FIG. 6 shows a relationship between an on-axis magnetic flux density on the center axis 30 of the electron beam 28 which is apart from the center axis 14 by 60 mm, and the axial distance from the design center coordinates of the cathode 26. A constant magnetic flux density is obtained in the range between 0 mm, at which the cathode 26 is located, and about 50 mm, which corresponds to a position immediately before leak magnetic fields from the holes 51 in the pole pieces 50 are applied to the electron beam 28. Thus, the deflection of the electron beam 28 can be suppressed.

As has been described above, the bucking magnet 52 of the electron-gun-unit-side magnetic field generating unit 41 is disposed around the electron gun unit 18, and the plural magnetic gaps 54 and 55 are provided in the axial direction in the inner peripheral surface of the electron-gun-unit-side magnetic pole 53 which covers the bucking magnet 52. Thereby, lines 42 of magnetic force, which are parallel to the center axis 14, can be generated. Even the electron beam 28, which is generated from the location apart from the center axis 14 of the electron gun unit 18, can be guided to the radio-frequency interaction unit 19 in the same manner as in the case where the electron beam 28 is generated from a location at the center axis 14 of the electron gun unit 18. Moreover, by using the matching magnets 46, the ripple of the electron beam 28 can be reduced.

Thus, simply with the provision of the electron-gun-unit-side magnetic field generating unit 41, the cathodes 26 of the electron gun unit 18, etc. can be disposed in a planar fashion, without making the electron gun unit 18 complex.

In an ordinary single-beam klystron apparatus, the electron-gun-unit-side pole piece needs to be provided with considerably large holes, relative to the diameter of each electron beam, in order to obtain an on-axis magnetic flux density which is necessary for convergence of the electron beams in the electron gun unit. In the present embodiment, since parallel magnetic fields are applied to the electron gun unit 18, each hole 51 in the pole piece 50 on the electron gun unit 18 side may have a minimum necessary diameter for passage of the electron beam 28. Therefore, it becomes possible to reduce the adverse effect on the electron beam 28 passing through the hole 51 in the pole piece 50 due to the magnetic field leaking from the holes 50 for other electron beams 28.

Figure 7:
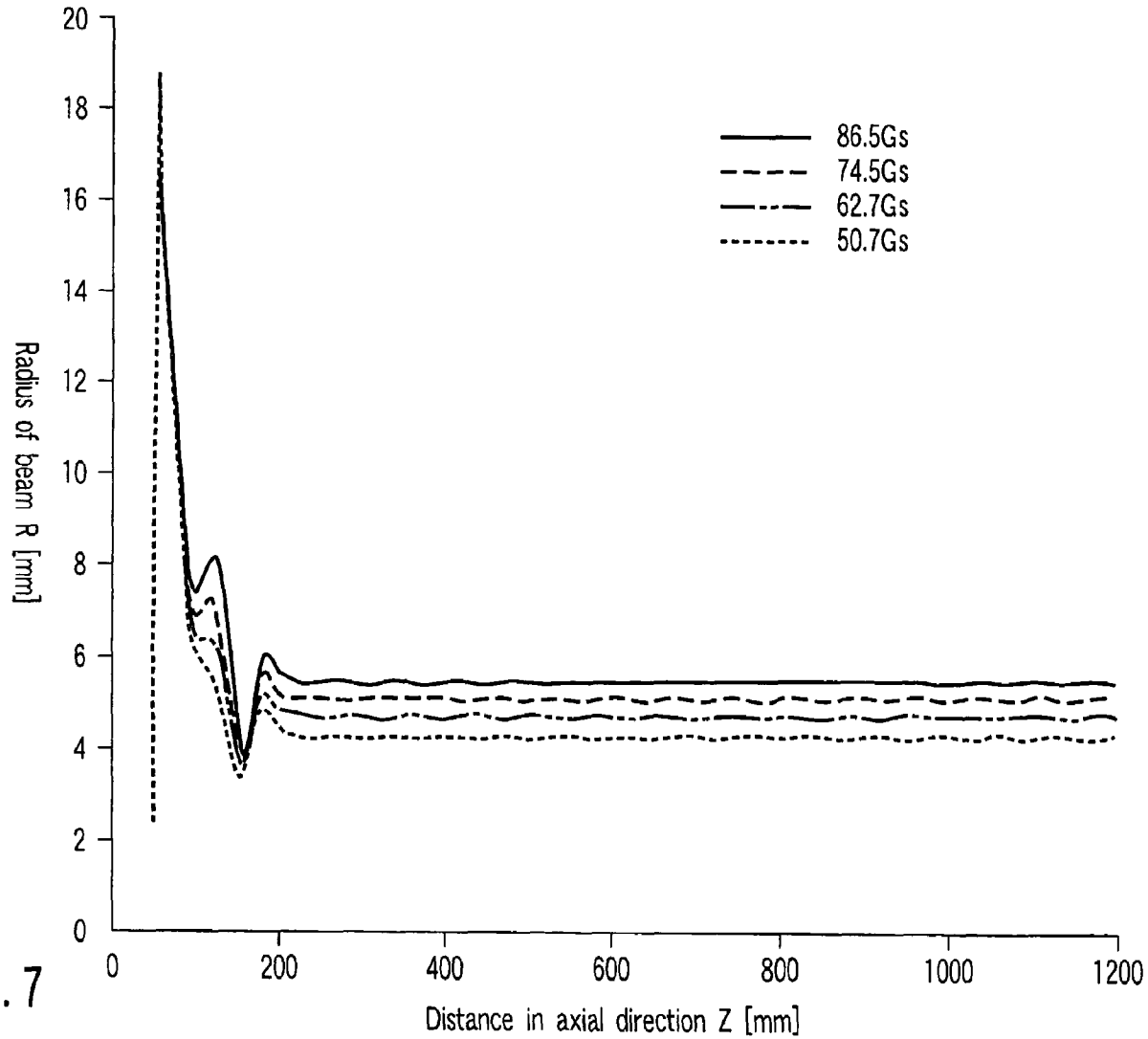
FIG. 7 is a graph showing a relationship between the axial distance from the cathode and the radius of the beam in a case where the cathode magnetic field of the multi-beam klystron apparatus is varied.

As is shown in FIG. 7, while the main magnetic field is kept constant, the cathode magnetic field of lines 42 of magnetic force, which are parallel to the center axis 14, may be varied by the bucking magnet 52 and the ripple adjustment may be performed by the matching magnets 46. Thereby, the diameter of a target electron beam 28 can freely be varied. For example, as shown in FIG. 7, if the cathode magnetic field is varied between 50.7 gauss (Gs), 62.6 Gs, 74.5 Gs and 86.5 Gs, the beam diameter can be adjusted in the range between 4.3 mm and 5.5 mm.

Figure 8:
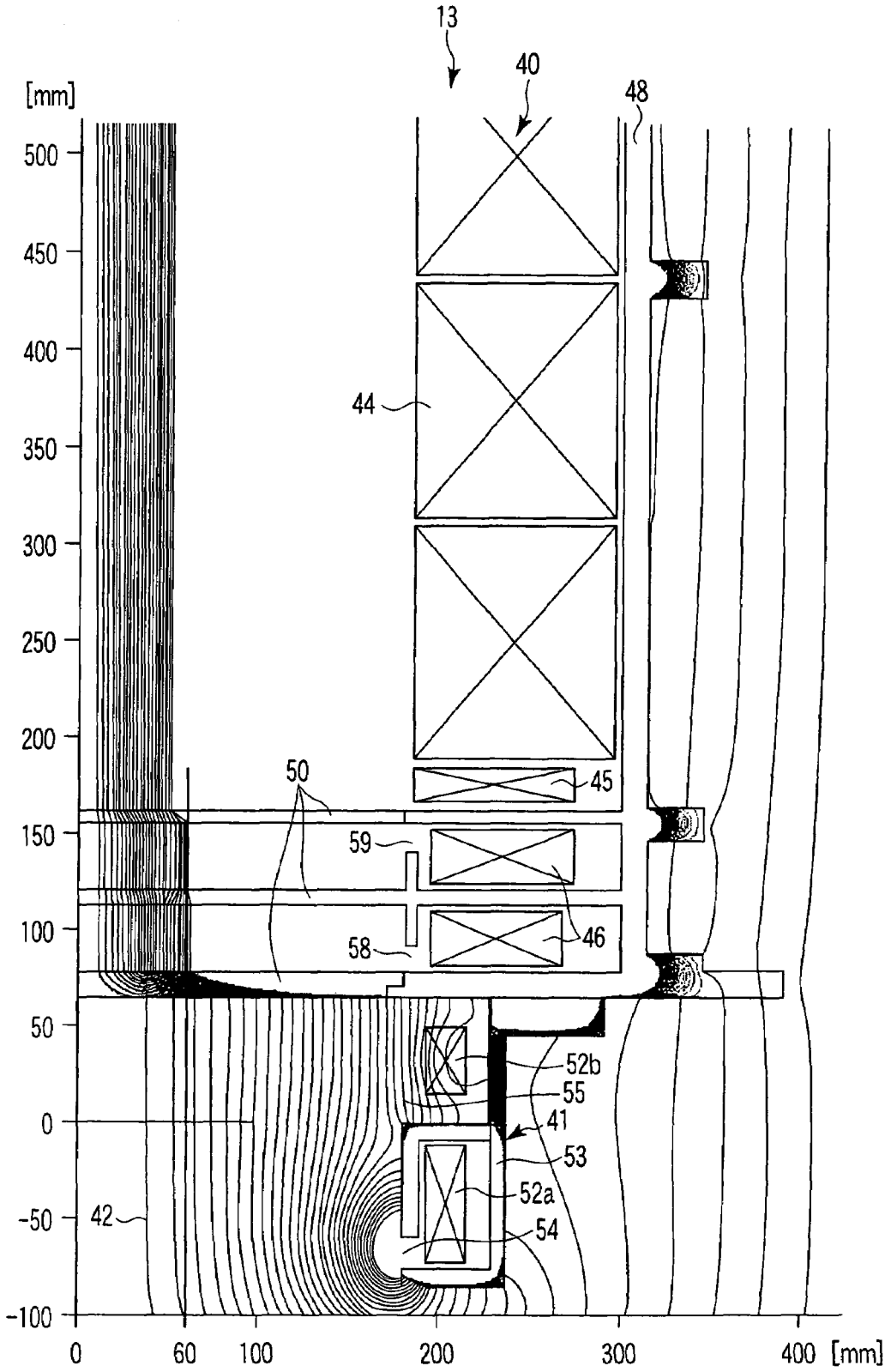
FIG. 8 is an explanatory view showing a line-of-magnetic-force analysis result of a converging magnetic field device of a multi-beam klystron apparatus according to a second embodiment of the invention.

FIG. 8 shows a second embodiment of the invention.

The parts common to those in the first embodiment are denoted by like reference numerals, and a description thereof is omitted.

In the electron-gun-unit-side magnetic field generating unit 41, a first bucking magnet 52*a* and a second bucking magnet 52*b* are arranged in the axial direction, and magnetic gaps 54 and 55 are formed on the inner peripheral surfaces of the bucking magnets 52*a* and 52*b* on the inner peripheral side of the electron-gun-unit-side magnetic pole 53. The magnetic gap 55 on the downstream side of the electron beam 28 is formed substantially in the open state. For example, by varying the condition of the second bucking magnet 52*b*, lines 42 of magnetic force, which are parallel to the center axis 14, can be obtained near the electron beam axis which is apart from the center axis 14.

FIG. 8 depicts the lines 42 of magnetic force only in the region where the leak magnetic fields from the magnetic gaps 54 and 55 on the inner peripheral side of the bucking magnets 52*a* and 52*b*. A scale value 60 mm on the abscissa indicates a design center value of the electron beam 28. A scale value 0 mm on the ordinate indicates design center coordinates of the cathode 26. In the case where the radius of the cathode 26 is set at 20 mm, it is understood that the lines 42 of magnetic force are substantially parallel to the center axis 14 in the range of 40 mm to 80 mm on the abscissa and in the range between 0 mm and the pole piece 50 on the ordinate.

Even if magnetic gaps are not provided in the magnetic pole, two bucking magnets may be arranged in the axial direction so as to obtain lines of magnetic force, which are parallel to the center axis, in the vicinity of the electron beam axis apart from the center axis.

Three or more bucking magnets may be arranged in the axial direction. In addition, three or more magnetic gaps of the magnetic pole may be provided in the axial direction. Thereby, lines of magnetic force, which are parallel to the center axis, can be generated.

It should suffice if at least one matching magnet is provided. However, two, or three or more matching magnets may be used.

A plurality of electron gun units may be provided independently in association with individual electron beams, and the wehnelt may be shared.

In the above-described multi-beam klystron apparatus, the magnetic field generating element of the electron-gun-unit-side magnetic field generating unit is disposed around the electron gun unit, and a plurality of magnetic gaps are provided in the inner peripheral surface of the magnetic pole, which covers the magnetic field generating element, in the direction of travel of the electron beams. Therefore, lines of magnetic force, which are parallel to the center axis of the radio-frequency interaction unit, can be generated. Thus, even the electron beam, which is generated from the location apart from the center axis of the electron gun unit, can be guided to the radio-frequency interaction unit in the same manner as in the case where the electron beam is generated from a location at the center axis of the electron gun unit.

Thus, simply with the provision of the electron-gun-unit-side magnetic field generating unit, the cathodes of the electron gun unit, etc. can be disposed in a planar fashion, without making the electron gun unit complex. Furthermore, for example, since each of the holes in the pole piece of the converging magnetic field device, through which electron beams pass, can be made smaller, it becomes possible to reduce the adverse effect on the electron beam passing through the hole in the pole piece due to the magnetic field leaking from the holes for other electron beams.

The multi-beam klystron apparatus according to this invention can be adapted for use in accelerator, etc.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A multi-beam klystron apparatus comprising:

an electron gun unit configured to generate a plurality of electron beams;

an input unit configured to input radio-frequency power;

a radio-frequency interaction unit configured to amplify the radio-frequency power, which is input from the input unit, by an interaction between the electron beams, which are generated by the electron gun unit, and a radio-frequency electric field;

an output unit configured to output the radio-frequency power from the radio-frequency interaction unit;

a collector unit configured to collect the electron beams which pass through the radio-frequency interaction unit; and a converging magnetic field device configured to include an electron-gun-unit-side magnetic field generating unit having a magnetic field generating element which is located around the electron gun unit and a magnetic pole which covers the magnetic field generating element and has a plurality of magnetic gaps in an inner peripheral surface thereof in a direction of travel of the electron beams, and configured to converge the electron beams generated by the electron gun unit.

2. The multi-beam klystron apparatus according to claim 1, wherein the magnetic field generating element of the electron-gun-unit-side magnetic field generating unit and the plurality of magnetic gaps of the magnetic pole are set in such a relationship as to generate lines of magnetic force, which are parallel to a center axis of the radio-frequency interaction unit at least in a range in which the electron beams generated by the electron gun unit reach the radio-frequency interaction unit.

3. The multi-beam klystron apparatus according to claim 1, wherein a plurality of said magnetic field generating elements of the electron-gun-unit-side magnetic field generating unit are provided in a direction of travel of the electron beams, and the magnetic pole is provided with the magnetic gaps which are formed at an inner peripheral surface of each of the magnetic field generating elements, the plurality of magnetic field generating elements and the plurality of magnetic gaps being set in such a relationship as to generate lines of magnetic force, which are parallel to a center axis of the radio-frequency interaction unit at least in a range in which the electron beams generated by the electron gun unit reach the radio-frequency interaction unit.

4. The multi-beam klystron apparatus according to claim 3, wherein the converging magnetic field device includes a main magnetic field generating element which is located around the radio-frequency interaction unit, and a magnetic field generating element for correction, which is configured to correct beam trajectories of the electron beams, is provided between the main magnetic field generating element and the magnetic field generating element of the electron-gun-unit-side magnetic field generating unit.

5. The multi-beam klystron apparatus according to claim 1, wherein the converging magnetic field device includes a main magnetic field generating element which is located around the radio-frequency interaction unit, and a magnetic field generating element for correction, which is configured to correct beam trajectories of the electron beams, is provided between the main magnetic field generating element and the magnetic field generating element of the electron-gun-unit-side magnetic field generating unit.

6. The multi-beam klystron apparatus according to claim 2, wherein the converging magnetic field device includes a main magnetic field generating element which is located around the radio-frequency interaction unit, and a magnetic field generating element for correction, which is configured to correct beam trajectories of the electron beams, is provided between the main magnetic field generating element and the magnetic field generating element of the electron-gun-unit-side magnetic field generating unit.

7. A multi-beam klystron apparatus comprising:

an electron gun unit configured to generate a plurality of electron beams;

an input unit configured to input radio-frequency power;

a radio-frequency interaction unit configured to amplify the radio-frequency power, which is input from the input unit, by an interaction between the electron beams, which are generated by the electron gun unit, and a radio-frequency electric field;

an output unit configured to output the radio-frequency power from the radio-frequency interaction unit;

a collector unit configured to collect the electron beams which pass through the radio-frequency interaction unit; and a converging magnetic field device configured to include an electron-gun-unit-side magnetic field generating unit having a plurality of magnetic field generating elements which are provided around the electron gun unit in a direction of travel of the electron beams, and configured to converge the electron beams which are generated by the electron gun unit.

8. The multi-beam klystron apparatus according to claim 4, wherein the converging magnetic field device includes a main magnetic field generating element which is located around the radio-frequency interaction unit, and a magnetic field generating element for correction, which is configured to correct beam trajectories of the electron beams, is provided between the main magnetic field generating element and the magnetic field generating element of the electron-gun-unit-side magnetic field generating unit.

* * * * *